US009790040B2

(12) United States Patent
Sugishima et al.

(10) Patent No.: US 9,790,040 B2
(45) Date of Patent: Oct. 17, 2017

(54) SHEET FEEDING DEVICE AND IMAGE FORMING APPARATUS INCLUDING THE SAME

(71) Applicant: KYOCERA Document Solutions Inc., Osaka (JP)

(72) Inventors: Yoshio Sugishima, Osaka (JP); Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/067,820

(22) Filed: Mar. 11, 2016

(65) Prior Publication Data

US 2016/0264368 A1 Sep. 15, 2016

(30) Foreign Application Priority Data

Mar. 13, 2015 (JP) ..... 2015-050334

(51) Int. Cl.
*B65H 1/04* (2006.01)
*B65H 1/26* (2006.01)
(Continued)

(52) U.S. Cl.
CPC ..... *B65H 1/266* (2013.01); *G03G 15/6502* (2013.01); *A47B 88/40* (2017.01); *B65H 2402/32* (2013.01); *B65H 2402/343* (2013.01); *B65H 2402/61* (2013.01); *B65H 2405/121* (2013.01); *B65H 2405/31* (2013.01); *B65H 2801/06* (2013.01); *G03G 2221/1684* (2013.01)

(58) Field of Classification Search
CPC ..... B65H 1/266; B65H 2405/121; B65H 2402/61; B65H 2402/343; B65H 2405/31; G03G 15/6502; G03G 2221/1684; A47B 88/04; A47B 88/12
See application file for complete search history.

(56) References Cited

U.S. PATENT DOCUMENTS 8,870,310 B2 * 10/2014 Kuba ..... A47B 88/0466 312/334.19
2005/0104492 A1 * 5/2005 Chiu ..... A47B 88/08 312/333

(Continued)

FOREIGN PATENT DOCUMENTS

JP 2013-035643 A 2/2013
JP 2014-111494 A 6/2014

*Primary Examiner* — Jeremy R Severson
(74) *Attorney, Agent, or Firm* — Studebaker & Brackett PC

(57) ABSTRACT

A sheet feeding device includes a sheet feeding cartridge, a pair of fixed rails, a pair of movable rails and a pressing part. The sheet feeding cartridge has a pair of side plates extending in taking-out/taking-in directions and is taken out/in an installed part in an apparatus main body. The fixed rails are extended in the taking-out/taking-in directions in the installed part. The movable rails are provided to move in the taking-out/taking-in directions along the fixed rails. If the pressing part is provided in one side plate, the pressing part applies biasing force to one movable rail facing to one side plate so that another side plate comes into pressure contact with another movable rail. If the pressing part is provided in one movable rail, the pressing part applies biasing force to one side plate so that another side plate comes into pressure contact with another movable rail.

19 Claims, 7 Drawing Sheets

(51) Int. Cl.
*G03G 15/00* (2006.01)
*A47B 88/40* (2017.01)

(56) References Cited

U.S. PATENT DOCUMENTS

| | | | | |
|---|---|---|---|---|
| 2008/0231156 | A1* | 9/2008 | Hoshide | A47B 88/047<br>312/334.46 |
| 2008/0246378 | A1* | 10/2008 | Chen | A47B 88/16<br>312/334.46 |
| 2013/0032996 | A1 | 2/2013 | Kubota et al. | |
| 2014/0062282 | A1* | 3/2014 | Nishioka | G03G 21/1623<br>312/334.44 |
| 2014/0203697 | A1* | 7/2014 | Wada | G03G 21/1633<br>312/333 |
| 2016/0231692 | A1* | 8/2016 | Hayayumi | G03G 15/6502 |

* cited by examiner

SHEET FEEDING DEVICE AND IMAGE FORMING APPARATUS INCLUDING THE SAME

INCORPORATION BY REFERENCE

This application is based on and claims the benefit of priority from Japanese Patent application No. 2015-050334 filed on Mar. 13, 2015, the entire contents of which are incorporated herein by reference.

BACKGROUND

The present disclosure relates to a sheet feeding device provided in an apparatus main body and an image forming apparatus including the sheet feeding device.

An image forming apparatus includes a sheet feeding cartridge for storing paper (sheet). In order to secure proper conveying of the sheet, the sheet feeding cartridge is located in a predetermined position in a state that the sheet feeding cartridge is installed in the apparatus main body.

The sheet feeding cartridge is drawn into a predetermined position of the apparatus main body (installed part) by a drawing device to be positioned. The drawing device includes a plate spring and an engaging part provided in a rear part of the installed part, and an engaged part provided in a rear part of the sheet feeding cartridge. The engaging part is engaged with the engaged part when the sheet feeding cartridge is installed in the installed part, and then, the sheet feeding cartridge is positioned.

Additionally, the sheet feeding cartridge includes two engagement holes engaging with two positioning pins provided in a slide rail. The sheet feeding cartridge is accurately positioned to the slide rail by fitting each positioning pin into each engagement hole. For the purpose of smooth fitting of each positioning pin, the shape and dimension of the two engagement holes are set in detail.

In the sheet feeding cartridge, the engaged part has come into slidingly contact with the engaging part whenever the sheet feeding cartridge is drawn out and pushed in. For example, in a case where a displaced engaged part is engaged with the engaging part, a large sliding load is generated in the engaging part and the engaged part. From this reason, in a manner in which the engaged part is engaged with the engaging part, it has been difficult to move a heavy sheet feeding cartridge fully filled with sheets to a normal position. That is, there has been a problem that the favorable positioning accuracy of the sheet feeding cartridge cannot be secured.

Further, in the sheet feeding cartridge, it is necessary to form the shape and the dimension of each engagement hole into which each positioning pin is inserted as designed. From this reason, in the sheet feeding cartridge, there has been a problem that higher accuracy for processing of each engagement hole is demanded, thereby increasing in manufacturing cost. Furthermore, the sheet feeding cartridge has not been capable of being attached to a slide rail unless each engagement hole is accurately positioned to each positioning pin. That is, workability of attachment of the sheet feeding cartridge to the slide rail has been worsened.

SUMMARY

In accordance with an embodiment of the present disclosure, a sheet feeding device includes a sheet feeding cartridge, a pair of fixed rails, a pair of movable rails and a pressing part. The sheet feeding cartridge is configured to have a pair of side plates extending in the taking-out and taking-in directions, to be formed so as to store a sheet, and to be taken-out and taken-in with respect to an installed part provided in an apparatus main body. The pair of fixed rails are extended in taking-out and taking-in directions of the sheet feeding cartridge in the installed part. The pair of movable rails support the sheet feeding cartridge and are provided to move in the taking-out and taking-in directions along the pair of fixed rails. The pressing part is provided in one side plate of the pair of side plates of the sheet feeding cartridge or one movable rail of the pair of movable rails facing to the one side plate. In a case where the pressing part is provided in the one side plate of the sheet feeding cartridge, the pressing part applies biasing force to the one movable rail in a direction orthogonal to the taking-out and taking-in directions, and thereby, makes another side plate facing to the one side plate in the sheet feeding cartridge to come into pressure contact with another movable rail facing to the one movable rail. In a case where the pressing part is provided in the one movable rail, the pressing part applies biasing force to the one side plate of the sheet feeding cartridge in a direction orthogonal to the taking-out and taking-in directions, and thereby, makes the other side plate of the sheet feeding cartridge to come into pressure contact with the other movable rail.

In accordance with an embodiment of the present disclosure, an image forming apparatus includes the sheet feeding device described above.

The above and other objects, features, and advantages of the present disclosure will become more apparent from the following description.

DETAILED DESCRIPTION

In the following, with reference to the attached drawings, suitable embodiments of the present disclosure will be described. In addition, hereinafter, it will be described so that the front side of the printer 1 is positioned at the front side of FIG. 1. Additionally, the embodiments will be described with reference to directions shown in each of the drawings.

Figure 1:
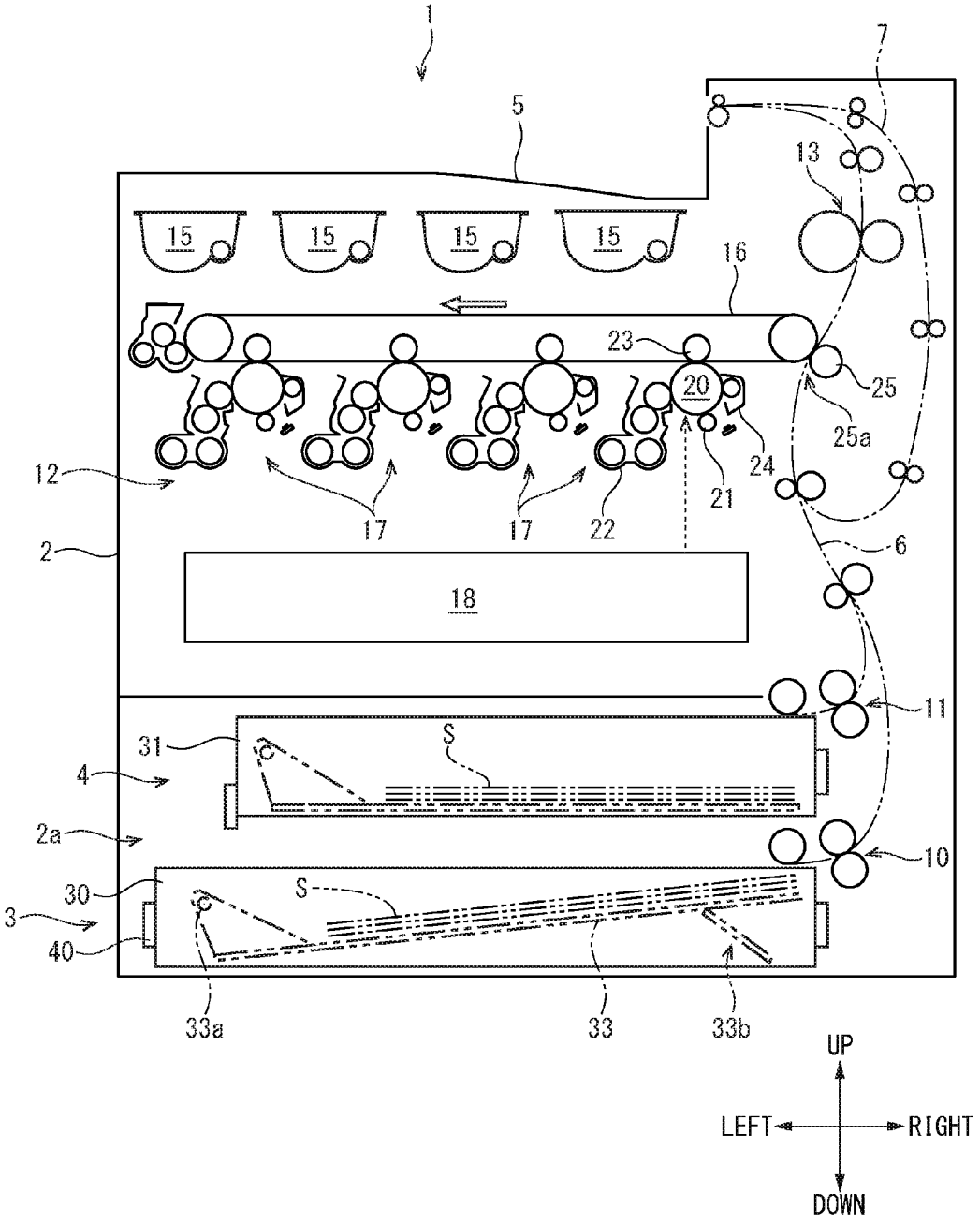
FIG. 1 is a front sectional view schematically showing an inner structure of a color printer according to one embodiment of the present disclosure.
Figure 2:
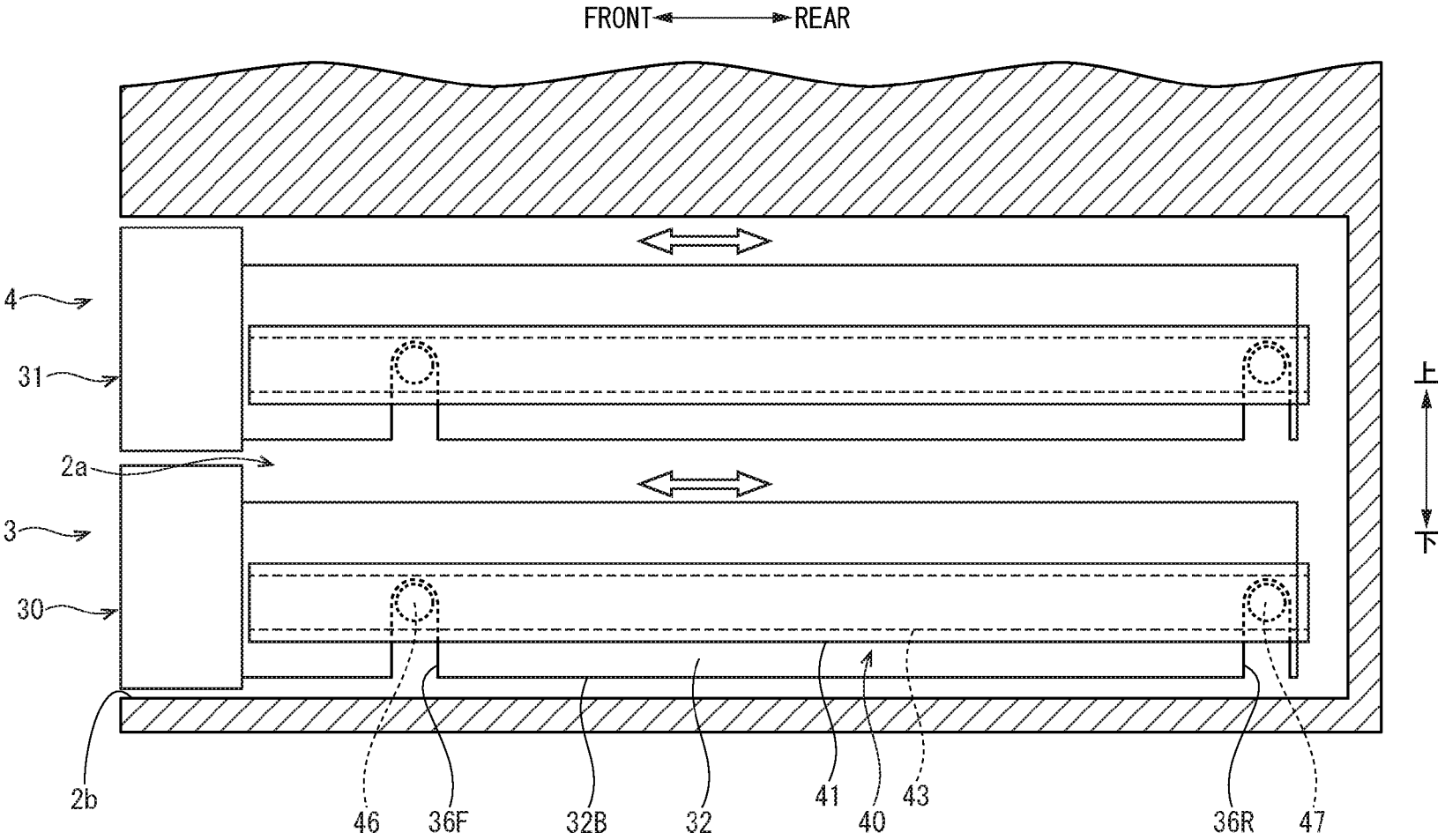
FIG. 2 is a side view schematically showing a sheet feeding device according to the one embodiment of the present disclosure.

With reference to FIG. 1 and FIG. 2, a color printer 1 as an image forming apparatus according to the present embodiment will be described. FIG. 1 is a front view schematically showing an inner structure of the color printer 1. FIG. 2 is a side view schematically showing sheet feeding devices 3 and 4.

As shown in FIG. 1, the color printer 1 includes an apparatus main body 2, two sheet feeding devices 3 and 4, and an ejected sheet tray 5. The apparatus main body 2 is formed in a roughly box-like shape. The two sheet feeding devices 3 and 4 are provided at a lower part of the apparatus main body 2 by being laminated in upward and downward directions. The ejected sheet tray 5 is provided at an upper part of the apparatus main body 2.

Although the details will be described later, the two sheet feeding devices 3 and 4 are respectively configured to include sheet feeding cartridges 30 and 31 (cassettes). Inside of each of the sheet feeding cartridges 30 and 31, pieces of sheet S (a bundle of laminated sheets S) are stored. As shown in FIG. 2, each of the sheet feeding cartridges 30 and 31 is attachably/detachably installed to an installed part 2*a* provided in the apparatus main body 2. The installed part 2*a* is a space arranged at a lower part of the apparatus main body 2, and has an installation opening 2*b* in a front face thereof. In addition, the sheet S stored in the sheet feeding cartridges 30 and 31 is not limited to be made of paper, and may be made of a resin film or the like.

As shown in FIG. 1, inside of the apparatus main body 2, a conveyance path 6 and an inversion path 7 are arranged. The conveyance path 6 is extended from each of the sheet feeding cartridges 30 and 31 to the ejected sheet tray 5. The inversion path 7 is arranged to communicate an upstream and a downstream of the conveyance path 6, thereby printing on both surfaces of the sheet S.

Further, the color printer 1 includes two sheet feeders 10 and 11, an image forming part 12, a fixing device 13 inside the apparatus main body 2. The two sheet feeders 10 and 11 are provided at an upstream side of the conveyance path 6 so as to correspond to each of the sheet feeding cartridges 30 and 31. The image forming part 12 is provided in an intermediate part of the conveyance path 6. The fixing device 13 is provided at a downstream side of the conveyance path 6.

The two sheet feeders 10 and 11 include a plurality of rollers and others feeding sheets S stored in the two sheet feeding cartridges 30 and 31 one by one to the conveyance path 6.

The image forming part 12 is configured to include four toner containers 15, an intermediate transferring belt 16, four drum units 17 and an optical scanning device 18. The four toner containers 15 are arranged in parallel in left and right directions at the lower side of the ejected sheet tray 5. The intermediate transferring belt 16 is travelably provided in a void arrow direction at the lower side of each toner container 15. The four drum units 17 are arranged in parallel in the left and right directions at the lower side of the intermediate transferring belt 16. The light scanning device 18 is provided at the lower side of each drum unit 17.

The four toner containers 15 contain four-color (yellow, magenta, cyan, black) toners (developers).

The four drum units 17 are provided so as to correspond with respective colors of the toners. Each drum unit 17 is configured to include a photosensitive drum 20, a charging device 21, a development device 22, a primary transfer roller 23 and a cleaning device 24. At the right side of the intermediate transferring belt 16, a secondary transfer roller 25 forming a secondary transfer nip part 25*a* is placed.

The sheet S fed by either of the two sheet feeding cartridges 30 and 31 is conveyed through the conveyance path 6 and is passed through the secondary transfer nip part 25*a*. The full color toner image primary-transferred onto the intermediate transferring belt 16 by the primary transfer roller 23 is secondary-transferred to the sheet S by the secondary transfer roller 25 to which a secondary transfer bias is applied. The fixing device 13 fixes the toner image onto the sheet S. The sheet S after fixing process is ejected onto the ejected sheet tray 5. Each cleaning device 24 removes the toner remaining on the surface of each photosensitive drum 20 after transferring.

Figure 3:
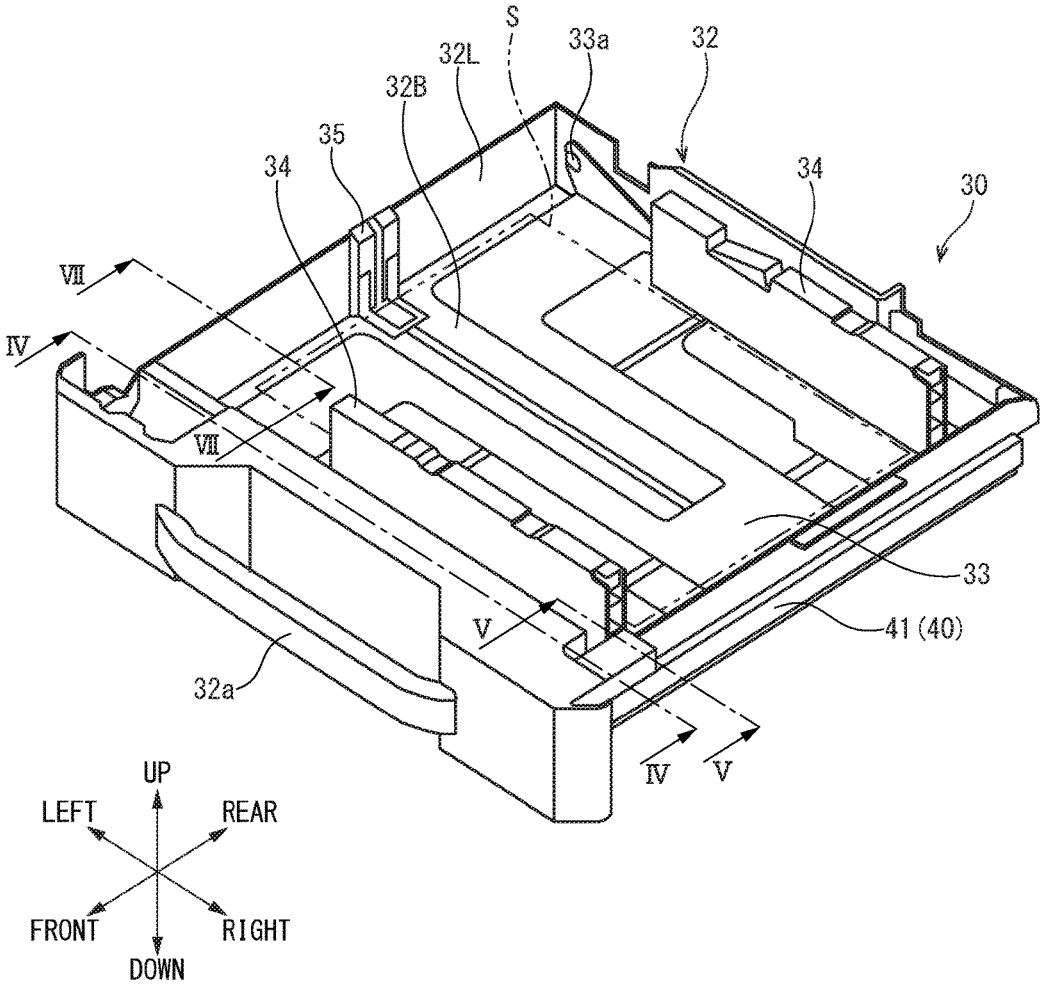
FIG. 3 is a perspective view showing a sheet feeding device according to the one embodiment of the present disclosure.
Figure 4:
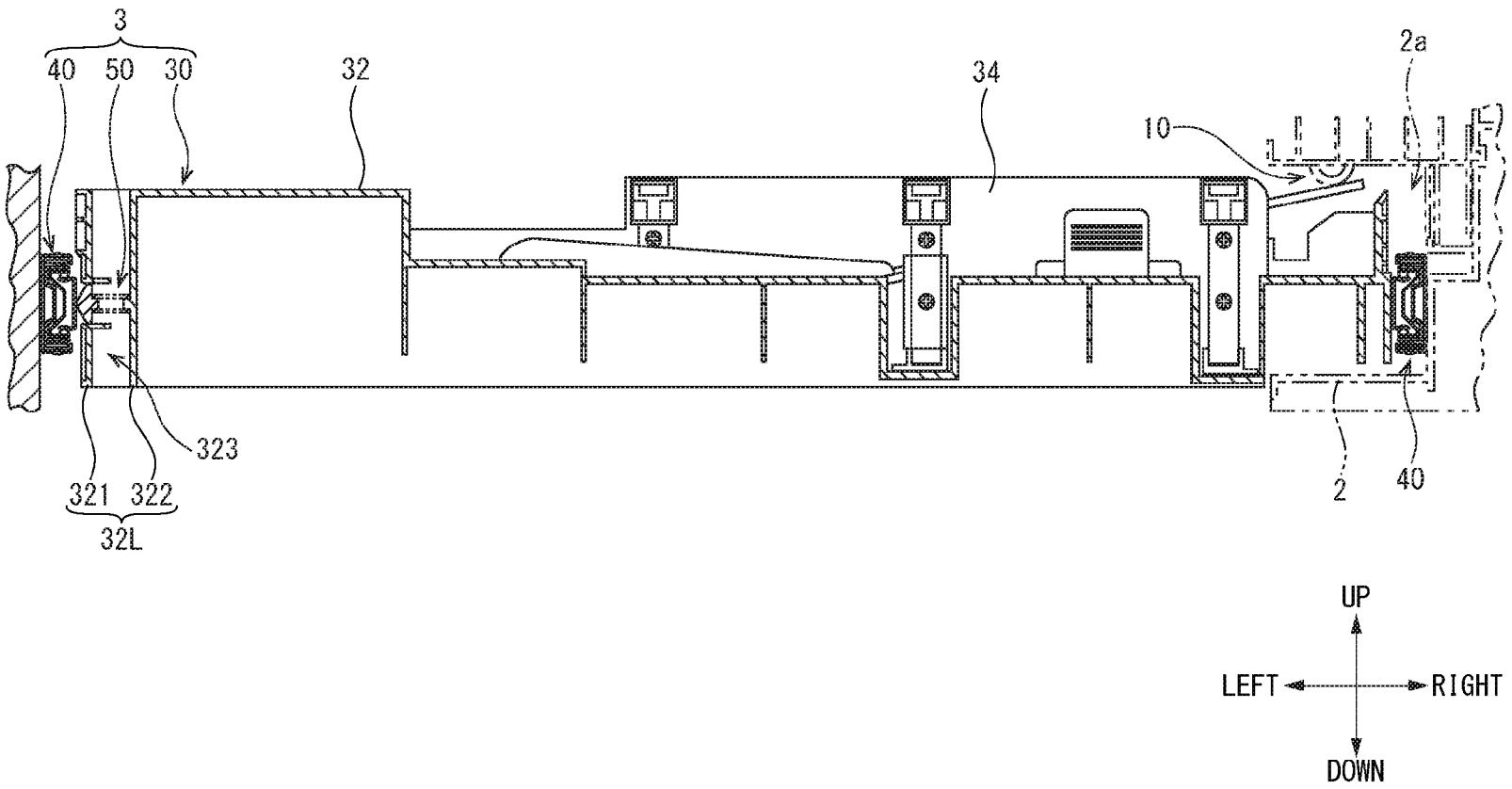
FIG. 4 is a sectional view along a IV-IV line in FIG. 3.
Figure 5:
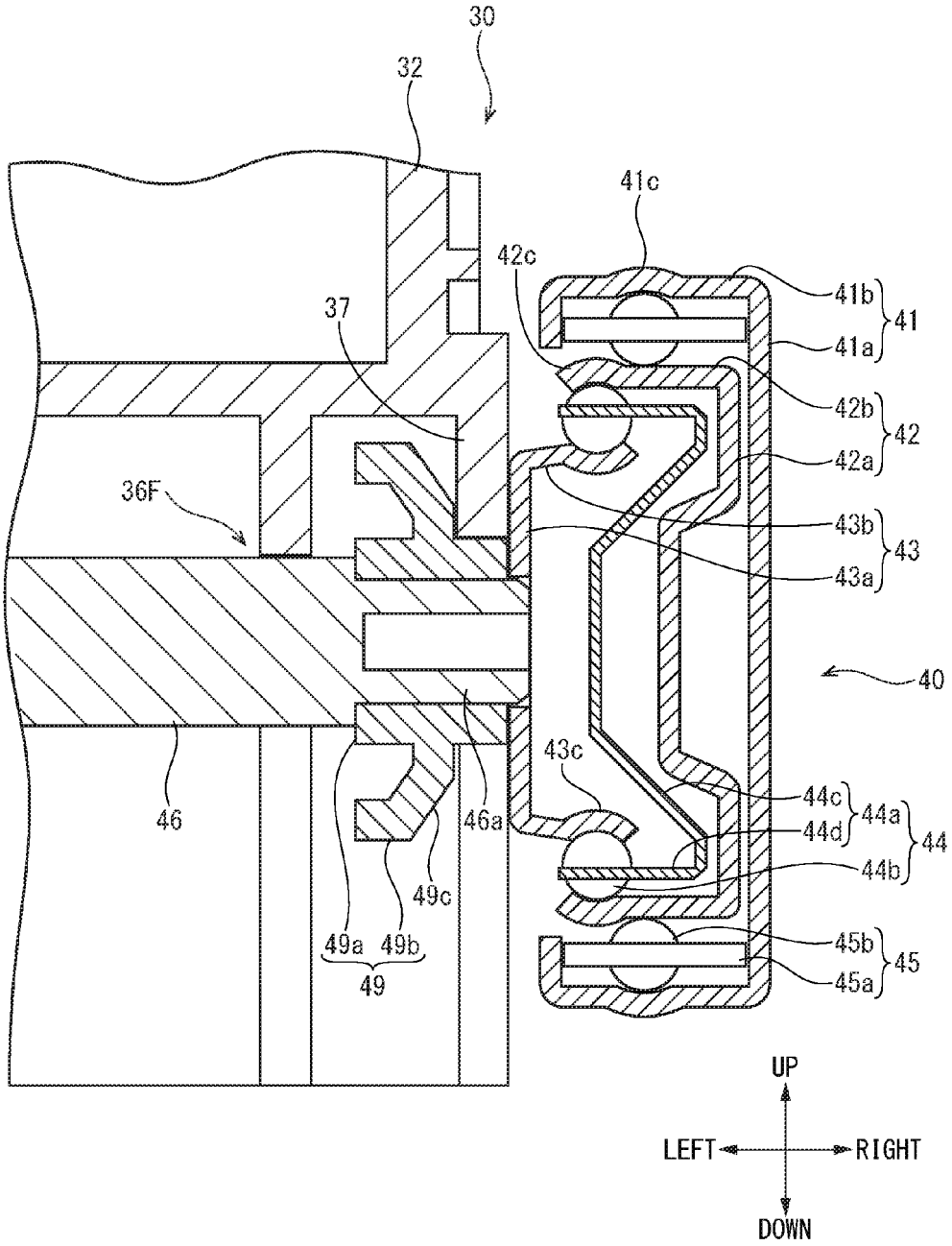
FIG. 5 is a sectional view along a V-V line in FIG. 3.
Figure 6:
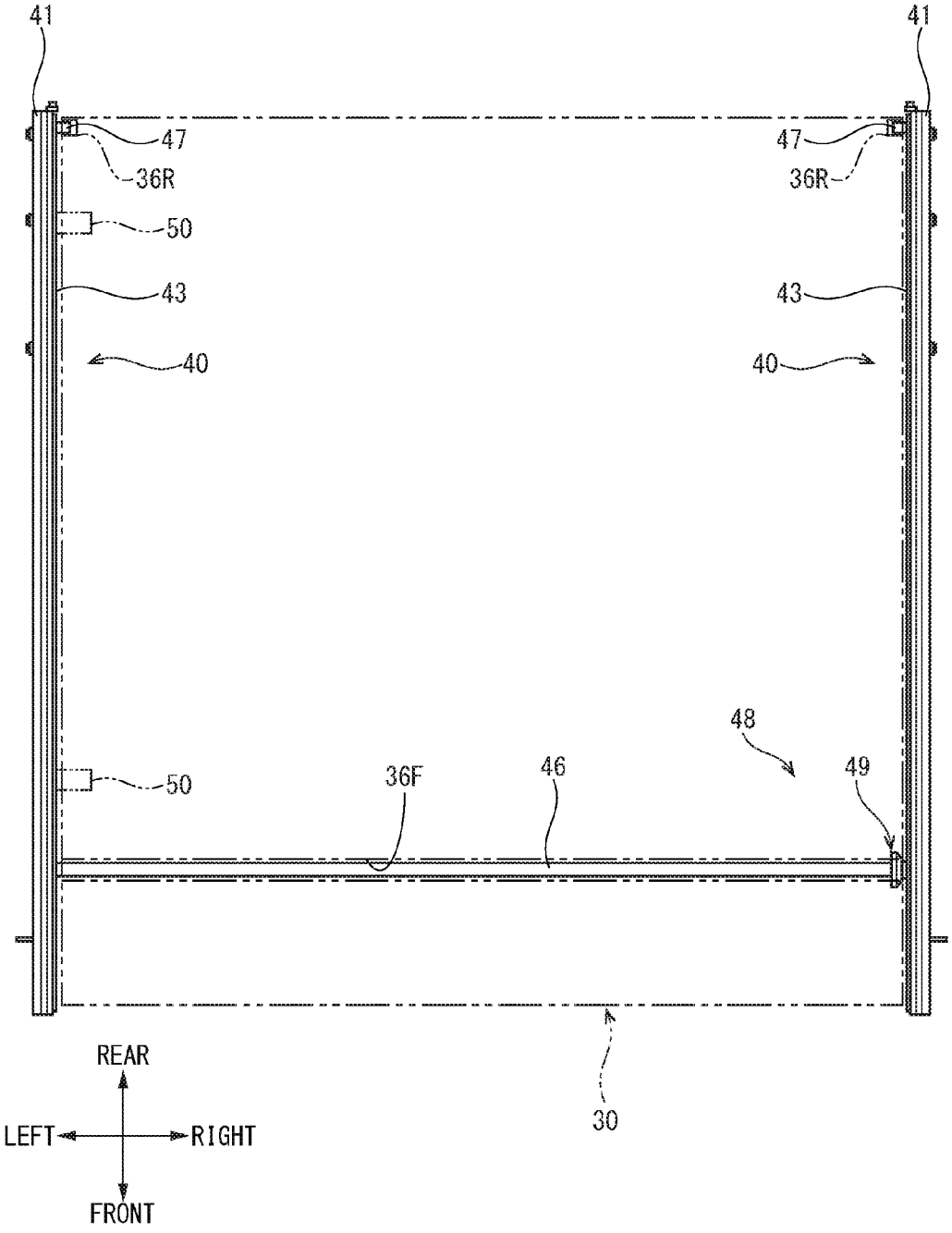
FIG. 6 is a plan view showing slide rails, a stay member and others of the sheet feeding device according to the one embodiment of the present disclosure.
Figure 7:
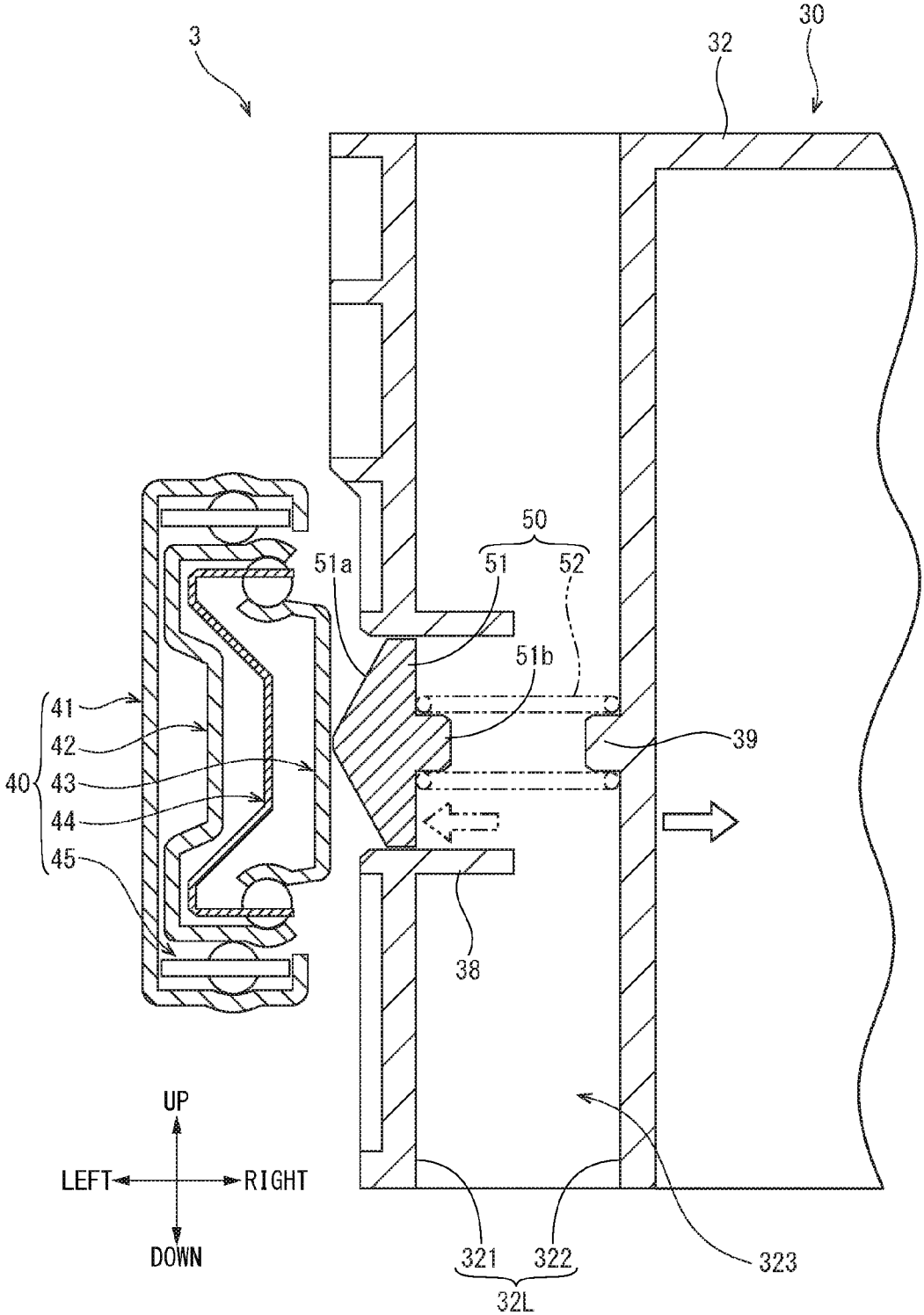
FIG. 7 is a sectional view along a VII-VII line in FIG. 3.

Next, with reference to FIG. 1 to FIG. 7, the sheet feeding devices 3 and 4 according to the present embodiment will be described. FIG. 3 is a perspective view showing the sheet feeding device 3. FIG. 4 is a sectional view along a IV-IV line in FIG. 3. FIG. 5 is a sectional view along a V-V line in FIG. 3. FIG. 6 is a plan view showing a slide rail and others. FIG. 7 is a sectional view along a VII-VII line in FIG. 3.

As shown in FIG. 1, the sheet feeding devices 3 and 4 are configured to include the two sheet feeding cartridges 30 and 31. The upper sheet feeding cartridge is formed shorter (narrower) in the left and right direction than the lower sheet feeding cartridge 30. Further, the upper sheet feeding cartridge 31 is provided at the right side inside the apparatus main body 2. Although illustration is omitted, at the left side of the upper sheet feeding cartridge 31, a waste toner bottle for storing unnecessary toner is provided. In addition, the two sheet feeding devices 3 and 4 are different in the width in the left and right directions and others of the sheet feeding cartridges 30 and 31, but have similar basic configurations. Therefore, hereinafter, the lower sheet feeding device 3 will be described, and description of the sheet feeding device 4 will be omitted.

As shown in FIG. 3 and FIG. 4, the sheet feeding device 3 is configured to include the sheet feeding cartridge 30, a pair of left and right slide rails 40 and a pair of front and rear pressing parts 50. The sheet feeding cartridge 30 is installed so as to be drawn out and pushed in (taken in and taken out) with respect to the installed part 2*a*. The pair of left and right slide rails 40 support the sheet feeding cartridge 30 so as to move in forward and backward directions. The pair of front and rear pressing parts 50 are provided at the left side of the sheet feeding cartridge 30.

As shown in FIG. 3, the sheet feeding cartridge 30 has a cartridge main body 32, a lift plate 33, a pair of front and rear first cursors 34 and a second cursor 35.

The cartridge main body 32 is formed in a roughly rectangular box-like shape whose upper face is opened. Inside of the cartridge main body 32, (a bundle of) the sheets S are stored. On the front face of the cartridge main body 32, a gripper 32*a* is provided so as to be gripped by a user when taking-out/taking-in the sheet feeding cartridge 30 with respect to the installed part 2*a*. The cartridge main body 32 of the sheet feeding cartridge 30 has a pair of side plates (left side plate 32L and right side plate) extending in taking-out and taking-in directions.

The lift plate 33 is located on a bottom plate 32B of the cartridge main body 32. In the left end part of the lift plate 33, a pair of front and rear plate rotation axes 33*a* are provided. The lift plate 33 is supported by the cartridge main body 32 so as to rotate around each plate rotation axis 33*a* in the upward and downward directions. The lift plate 33 is pushed up by a lifting mechanism 33*b* (see FIG. 1). The sheet S on the lift plate 33 pushed up is fed to the conveyance path 6 by the above-mentioned sheet feeder 10.

The pair of front and rear first cursors 34 are respectively formed in a roughly rectangular shape elongated in the left and right directions, and are provided on the bottom plate 32B of the cartridge main body 32. The pair of front and rear first cursors 34 are arranged so as to face to each other across the lift plate 33, and are connected to an interlocking mechanism (not shown), such as a rack and pinion mechanism. The pair of front and rear first cursors 34 is slid symmetrically in the front and rear directions to align (bundle of) the sheets S placed on the lift plate 33 with respect to respective widths in the front and rear directions.

The second cursor 35 is formed in a roughly L-shape in a front view, and is provided on the bottom plate 32B of the cartridge main body 32. The second cursor 35 is slid in the left and right directions to align (bundle of) the sheets S placed on the lift plate 33 with respect to respective widths in the left and right directions.

As shown in FIG. 2, on a lower face of the bottom plate 32B of the cartridge main body 32, a front side recessed part 36F (a first recessed part) located at an upstream side in the taking-out direction (a drawing-out direction of the sheet feeding cartridge 30) of the sheet feeding cartridge 30 and a pair of left and right rear side recessed parts 36R (second recessed parts) located at a downstream side in the taking-out direction of the sheet feeding cartridge 30 are recessed. Although the details will be described later, into the front side recessed part 36F, a stay member 46 is fitted, and into each rear side recessed part 36R, each supporting pin 47 is fitted (refer to FIG. 6). In a right end part of the front side recessed part 36F, a fitting part 37 is protruded downwardly (refer to FIG. 5). In addition, a right side face of the fitting part 37 is formed the same plane as a right side face of the cartridge main body 32.

As shown in FIG. 4 and FIG. 5, the pair of left and right slide rails 40 are respectively configured to include fixed rails 41, intermediate rails 42, movable rails 43, first retainers 44 and pairs of upper and lower second retainers 45. The pair of left and right fixed rails 41 are extended in the taking-out and taking-in directions (forward and backward directions) of the sheet feeding cartridge 30 and arranged in the installed part 2*a* across the sheet feeding cartridge 30. The pair of left and right intermediate rails 42 are provided so as to move in the forward and backward directions along the fixed rails 41. The pair of left and right movable rails 43 support the sheet feeding cartridge 30 and are provided so as to move in the forward and backward directions along the respective fixed rails 41. The pair of left and right first retainers 44 are provided between the intermediate rails 42 and the movable rails 43. The pair of left and right second retainers 45 (one pair of upper and lower second retainers) are provided between the fixed rails 41 and the intermediate rails 42. In addition, the pair of left and right slide rails 40 have same configurations placed so as to be symmetrical in the left and right directions, and accordingly, hereinafter, mainly the right side slide rail 40 will be described.

As shown in FIG. 2, the fixed rail 41 is made of a plate metal and are formed elongating in the forward and backward directions. The fixed rail 41 is formed somewhat shorter than the length in the forward and backward directions of the apparatus main body 2. The fixed rail 41 is fixed on an inner wall face of the installed part 2*a* so as to be approximately horizontal.

As shown in FIG. 5, the fixed rail 41 has a pair of fixed bent parts 41*b* extending from both of upper and lower end parts of a fixed base plate 41*a* to one side (left side), and are formed in a roughly C-shape in a sectional view. The fixed rail 41 makes the fixed base plate 41*a* to come into contact with the inner wall face of the installed part 2*a* while making each fixed bent part 41*b* oriented to a central side (left side) in the left and right directions (refer to FIG. 4). On opposing faces (inner faces) of the pair of upper and lower fixed bent parts 41*b*, fixed curved gaps 41*c* extending in the forward and backward directions are respectively recessed. Each fixed curved gap 41*c* has a curvature corresponding to the curvature of each of balls 45*b* of the second retainer 45 described below.

The intermediate rail 42 is made of a plate metal and are formed in an approximately same length as the fixed rail 41. The intermediate rail 42 has a pair of intermediate bent parts 42*b* extending from both of upper and lower end parts of an intermediate base plates 42*a* to one side (left side), and is formed in a roughly C-shape in a sectional view. The intermediate rail 42 is placed inside the fixed rail 41 in a posture that each intermediate bent part 42*b* is oriented to a left side. On opposing surfaces (inner surfaces) of the pair of upper and lower intermediate bent parts 42*b*, intermediate curved gaps 42*c* extending in the forward and backward directions are respectively recessed. Each intermediate curved gap 42*c* has a curvature corresponding to the curvature of each of balls 44*b* of the first retainer 44 described later.

The movable rail 43 is made of a plate metal and is formed in an approximately same length as the fixed rail 41. The movable rail 43 has a pair of movable bent parts 43*b* extending from both of upper and lower end parts of movable base plate 43*a* to another side (right side), and is formed in a roughly C-shape in a sectional view. The movable rail 43 is placed inside of the intermediate rail 42 in a posture that the movable bent part 43*b* is oriented to a right side. Although the details are described later, the movable base plate 43*a* of the right side movable rail 43 comes into contact with the right side face of the sheet feeding cartridge 30 (cartridge main body 32). On the outer faces of a pair of upper and lower movable bent parts 43*b*, movable curved gaps 43*c* extending in the forward and backward directions are respectively recessed. Each movable curved gap 43*c* has a curvature corresponding to the curvature of each of the balls 44*b* of the first retainer 44.

The first retainer 44 has a first frame 44*a* and a plurality of balls 44*b*. The first frame 44*a* retains the plurality of balls 44*b* rolling along the intermediate rail 42 and the movable rail 43.

The first frame 44*a* is made of a plate metal and is formed in an approximately half-length of the intermediate rail 42. The first frame 44*a* has a pair of first bent parts 44*d* extending from both upper and lower end parts of the first base plate 44*c* to one side (left side). The first base plate 44*c* is formed in a roughly C-shape in a sectional view, and is placed between the intermediate base plate 42*a* and the movable base plate 43*a*. The pair of upper and lower first bent parts 44*d* are formed in a roughly L-shape symmetrically in the upward and downward directions in a sectional view. The pair of upper and lower first bent parts 44*d* are respectively placed between the intermediate bent parts 42*b* and the movable bent parts 43*b*.

The plurality of balls 44*b* are arranged in each first bent part 44*d* in parallel in the forward and backward directions. Each ball 44*b* penetrate each first bent part 44*d* in the upward and downward directions, and is supported so as to rotate around a rotation axis (not shown) extending in the left and right directions. Each ball 44*b* is rollably fitted between the intermediate curved gap 42*c* of the intermediate rail 42 and the movable curved gap 43*c* of the movable rail 43.

The pair of upper and lower second retainers 45 respectively have second frames 45*a* and a plurality of balls 45*b*. Each second frame 45*a* is made of a synthetic resin and is formed in an approximately half-length of the fixed rail 41. Each second frame 45*a* is formed in a roughly rectangular plate in a plan view. The plurality of balls 45*b* are provided in each second frame 45*a* in parallel in the forward and backward directions. Each ball 45*b* penetrates each second retainer 45 in the upward and downward directions, and is supported so as to rotate around a rotation axis (not shown) extending in the left and right directions. Each ball 45*b* is rollably fitted between the fixed curved gap 41*c* of the fixed rail 41 and the outer face of the intermediate bent part 42*b* of the intermediate rail 42.

Rotation of each ball 44*b* of the first retainer 44 allows the movable rail 43 to smoothly slide with respect to the slide intermediate rail 42. Similarly, rotation of each ball 45*b* of each second retainer 45 allows the intermediate rail 42 to smoothly slide with respect to the fixed rail 41. In addition, in a front end part of the fixed rail 41, an intermediate front end stopper (not shown) restricting the maximum drawing-out amount of the intermediate rail 42 is formed. In a rear end part of the fixed rail 41, an intermediate rear end stopper (not shown) defining the maximum pushing-in position of the intermediate rail 42 is formed. In addition, in a front end part of the intermediate rail 42, a movable front end stopper (not shown) restricting the maximum drawing-out amount of the movable rail 43 is formed. In a rear end part of the intermediate rail 42, a movable rear end stopper (not shown) defining the maximum pushing-in position of the movable rail 43 is formed.

As shown in FIG. 6, between the pair of left and right movable rails 43, a stay member 46 is bridged. The stay member 46 is formed in a round bar shape elongated in the left and right directions. The stay member 46 is placed at front sides of the movable rails 43 (a downstream side in a drawing-out direction of the sheet feeding cartridge 30 from the installed part 2*a*), and is fixed to the movable base plates 43*a* (refer to FIG. 5). The stay member 46 keeps a distance between the pair of left and right movable rails 43 constant. Further, in the rear end parts of the pair of left and right movable rails 43 (at the downstream side in the drawing-out direction of the sheet feeding cartridge 30), the supporting pins 47 are respectively protruded toward the center in the left and right directions. Each of the pair of left and right supporting pins 47 is formed in a cylindrical shape. The pair of left and right movable rails 43, the stay member and the pair of left and right supporting pins 47 construct a frame body 48 supporting the sheet feeding cartridge 30.

In the stay member 46, a guide member 49 is protruded in the vicinity of the other side (right side) movable rail 43. Specifically, as shown in FIG. 5, the guide member 49 is provided in a right end part of the stay member 46 so as to come into contact with the movable base plate 43*a* of the right side movable rail 43. In addition, in the right end part of the stay member 46 provided with the guide member 49, a small diameter part 46*a* having a smaller diameter than other parts is formed.

The guide member 49 has a bearing 49*a* and a tapered part 49*b*, and is formed in a roughly disc-like shape. The bearing 49*a* is formed in a cylindrical shape, and is rotatably supported to the small diameter part 46*a*. The tapered part 49*b* is fixedly installed on the circumferential face of the bearing 49*a*, and is formed in an annular shape in a side view. The tapered part 49*b* has a tapered face 49*c* tapering toward the right side movable rail 43.

As shown in FIG. 4, the pair of front and rear pressing parts 50 are internally arranged in the left side plate 32L extending in the taking-out and taking-in directions of the cartridge main body 32. Here, the left side plate 32L of the cartridge main body 32 is formed in a hollow shape interposing an inner space 323 between an outer plate 321 and an inner plate 322. As shown in FIG. 7, in the outer plate 321, a guide cylinder part 38 formed in a cylindrical shape extending in the left and right directions with being opened in the outer face is formed. In the inner plate 322, a spring bracket boss 39 is formed on the same shaft center as the guide cylinder part 38.

As shown in FIG. 6, the pair of front and rear pressing parts 50 are provided apart from each other in the forward and backward directions. In a state that the sheet feeding cartridge 30 is supported by the frame body 48, the front side pressing part 50 is placed at the back side of the stay member 46, and the back side pressing part 50 is placed at the front side of the supporting pin 47. In addition, the pair of front and rear pressing parts 50 have the same configurations, and accordingly, hereinafter, one (for example, front side) of the pressing parts 50 will be described.

As shown in FIG. 7, the pressing part 50 has a contacting member 51 and a coil spring 52. The contacting member 51 is provided in the sheet feeding cartridge 30 so as to move in the left and right directions (width direction orthogonally crossing the taking-out and taking-in directions). The coil spring 52 as a biasing member presses the contacting member 51 against the left side movable rail 43.

The contacting member 51 is formed in a roughly conical shape, and has a tapered face 51*a* tapering toward the left side movable rail 43. On a right end face (bottom face of a cone) of the contacting member 51, a spring engaging boss 51*b* is protruded. The contacting member 51 is placed inside the guide cylinder part 38 of the left side plate 32L of the cartridge main body 32. The contacting member 51 is slid along the inner circumferential face of the guide cylinder part 38 in the left and right directions.

The coil spring 52 is bridged between the inner plate 322 of the left side plate 32L and the contacting member 51. A right end part of the coil spring 52 is fixed to the spring bracket boss 39 of the left side plate 32L, and a left end part of the coil spring 52 is fixed to the spring engaging boss 51*b* of the contacting member 51. The coil spring 52 biases the contacting member 51 toward the left direction. In addition, instead of the coil spring 52, for example, a rubber or the like that is subject to elastic deformation may be used as a biasing member.

Next, attachment of the sheet feeding cartridge 30 to the frame body 48 will be described. In addition, each intermediate rail 42 and each movable rail 43 are assumed to be drawn out to respective maximum charging positions.

First, an operator places the sheet feeding cartridge 30 above the frame body 48, and makes the sheet feeding cartridge 30 to be entered between the pair of left and right movable rails 43 from the upper side in a state that the pair of the movable rails 43 are drawn out. The operator makes the stay member 46 and each supporting pin 47 to be fitted into the front side recessed part 36F and each rear side recessed part 36R of the sheet feeding cartridge 30 (refer to FIG. 2). That is, the front side recessed part 36F and each rear side recessed part 36R are respectively supported by the stay member 46 and each supporting pin 47.

When the stay member 46 is fitted into the front side recessed part 36F of the sheet feeding cartridge 30, the fitting part 37 of the sheet feeding cartridge 30 comes into contact with the tapered face 49*c* of the guide member 49. The fitting part 37 is slid on the tapered face 49*c* to be fitted between the right side movable rail 43 (movable base plate 43*a*) and the guide member 49 (refer to FIG. 5). As described above, the tapered face 49*c* of the guide member 49 guides the fitting part 37 of the cartridge main body 32 entering between the right side movable rail 43 and the guide member 49 from the upper side. Thereby, it is possible to smoothly fit the fitting part 37 between the movable rail 43 and the guide member 49. That is, workability for attachment of the sheet feeding cartridge 30 to the stay member 46 (frame body 48) can be improved. As described above, by fitting of the fitting part 37 of the sheet feeding cartridge 30 between the right side movable rail 43 and the guide member 49, it is possible to place the sheet feeding cartridge 30 on the stay member 46 (frame body 48) in a positioned state.

Further, when the sheet feeding cartridge 30 is entered between the pair of movable rails 43 from the upper side, the tapered face 51*a* of the contacting member 51 of each pressing part 50 comes into contact with the left side movable rail 43 (exactly, a corner portion between the movable base plate 43*a* and the upper side movable bent part 43*b*) (refer to FIG. 5 and FIG. 7). As the sheet feeding cartridge 30 is descended, each contacting member 51 moves to the right direction to counter biasing force applied by the coil spring 52, and then, the left side movable rail 43 relatively slides from the tapered face 51*a* to the top of each contacting member 51. As described above, the tapered face 51*a* of each contacting member 51 comes into slidingly contact with the left side movable rail 43, and guides the cartridge main body 32 (sheet feeding cartridge 30) entering between the pair of movable rails 43 from the upper side. Thereby, it is possible to smoothly enter the sheet feeding cartridge between the pair of movable rails 43. That is, workability for attachment of the sheet feeding cartridge 30 can be improved.

Further, the sheet feeding cartridge 30 is placed between the pair of left and right movable rails 43 from the upper side, and is placed on the stay member 46 and each supporting pin 47. In such a state, each pressing part 50 applies biasing force to one side movable rail 43 of the pair of side movable rails 43 facing to one side plate (left side plate 32L) of the pair of side plates in the cartridge main body 32, i.e. the left side movable rail 43 (movable base plate 43*a*) (refer to a two-dot chain line arrows in FIG. 7) and makes another side plate (right side plate) facing to the one side plate (left side plate 32L) of the sheet feeding cartridge 30 to come into pressure contact with another side movable rail 43 facing to the one side movable rail 43, i.e. the right side movable rail 43 (movable base plate 43*a*) (refer to a void arrow in FIG. 7). That is, the sheet feeding cartridge 30 is positioned with reference to a state coming closely contact with the right side movable rail 43 (movable base plate 43*a*) (refer to FIG. 5). By the above-mentioned configuration, the sheet feeding cartridge 30 is supported by the installed part 2*a* in a state capable of drawing-out/pushing-in in the forward and backward directions via the frame body 48.

According to the sheet feeding device 3 of the present embodiment as described above, the sheet feeding cartridge 30 is pressed by each pressing part 50 to come into closely contact with the right side (other side) movable rail 43, and is accurately positioned along the right side movable rail 43. Further, the sheet feeding cartridge 30 is movably supported by the frame body 48 in a state positioned with reference to the right side movable rail 43. Therefore, the position of the sheet feeding cartridge 30 does not vary whenever the sheet feeding cartridge 30 is taken out and taken in. That is, accuracy of the positioning of the sheet feeding cartridge 30 to the installed part 2*a* can be improved. Further, each pressing part 50 only needs to have a function of pushing the sheet feeding cartridge 30 into the right side movable rail 43, for example, a function of biasing the sheet feeding cartridge 30, and is not required to have high accuracy for manufacturing and processing of each pressing part 50. Thereby, it is possible to simplify the structure of each pressing part 50 and to reduce manufacturing cost of each pressing part 50.

Further, according to the sheet feeding device 3 of the present embodiment, the biasing force applied by the coil spring 52 (refer to two-dot chain line arrows in FIG. 7) is applied to the left side movable rail 43 via the contacting member 51, and thereby, reaction force from the movable rail 43 (refer to the void arrow in FIG. 7) is applied to the sheet feeding cartridge 30 via the contacting member 51. Accordingly, the sheet feeding cartridge 30 comes into pressure contact with the right side movable rail 43. By such a function of each pressing part 50, the sheet feeding cartridge 30 becomes a positioned state only by being placed between the pair of left and right movable rails 43. Thereby, it is possible to easily carry out attachment of the sheet feeding cartridge 30 to each movable rail 43. Further, a plurality of the pressing parts 50 are arranged apart from each other in the taking-out and taking-in directions, for example, two pressing parts 50 are placed in the forward and backward directions, and thereby, the sheet feeding cartridge 30 can be placed along the entirety of the right side movable rail 43.

In addition, the sheet feeding device 4 whose detailed description has been omitted also achieves actions and effects similar to the sheet feeding device 3.

In addition, although the sheet feeding device 3 of the present embodiment includes two pressing parts 50, the pressing parts 50 may be provided in number of more than two. Further, for example, if the front part of the sheet feeding cartridge 30 is positioned by fitting the fitting part 37 between the right side movable rail 43 and the guide member 49, the front side pressing part 50 may be omitted. In this case, one pressing part 50 may only be provided at the rear side of the sheet feeding cartridge 30.

In addition, the sheet feeding device 3 of the present embodiment is positioned by making the sheet feeding cartridge 30 to come into closely contact with the right side movable rail 43, but the present disclosure is not limited to this. The sheet feeding cartridge 30 may be positioned with reference to a state coming into closely contact with the left side movable rail 43 (movable base plate 43*a*). For example, each pressing part 50 may be provided at the right side of the cartridge main body 32, and the guide member 49 may be provided at the left side of the stay member 46.

In addition, in the sheet feeding device 3 of the present embodiment, each pressing part 50 is provided in the sheet feeding cartridge 30, but the present disclosure is not limited to this. For example, each pressing part 50 may be also provided in either one of the pair of left and right movable rails 43. That is, each pressing part only needs to be provided in the sheet feeding cartridge 30 or one of the movable rails 43. For example, the pressing part 50 may be provided one movable rail 43 (left side movable rail 43) of the pair of movable rails 43 facing to one side plate (left side plate 32L) of the pair of side plates in the cartridge main body 32, that is, the contacting member 51 and the coil spring 52 may be provided in the left side movable rail 43. Then, the pressing part 50 may apply the biasing force to the sheet feeding cartridge 30, and then, may make the contacting member 51 to come into pressure contact with the left side plate 32L of the cartridge main body 32 and make the sheet feeding cartridge 30 to come into pressure contact with the other movable rail 43 (right side movable rail 43) facing to the one movable rail 43 (left side movable rail 43). In this case, the tapered face 51*a* of the contacting member 51 is oriented to a side of the cartridge main body 32.

In addition, although the sheet feeding device 3 of the present embodiment includes one stay member 46, the stay member 46 may be provided in number of two or more. In this case, the guide member 49 also may be provided preferably in a plural number in accordance with the number of the stay member 46. In addition, the guide member 49 is rotatably supported by the stay member 46, but not limited to this, and the guide member 49 may be fixed to the stay member 46.

In the present embodiment, a case where the configuration of the present disclosure is applied to the color printer 1 has been described. Meanwhile, in the other different embodiments, the configuration of the disclosure may be applied to another image forming apparatus, such as a monochrome printer, a facsimile or a copying machine.

Further, the above-description of the embodiments was described about one example of the sheet feeding device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

What is claimed is:

1. A sheet feeding device comprising:

a sheet feeding cartridge configured to have a pair of side plates extending in taking-out and taking-in directions, to be formed so as to store a sheet, and to be taken-out and taken-in with respect to an installed part provided in an apparatus main body;

a pair of fixed rails extended in the taking-out and taking-in directions of the sheet feeding cartridge in the installed part;

a pair of movable rails supporting the sheet feeding cartridge and being provided to move in the taking-out and taking-in directions along the pair of fixed rails; and a pressing part provided in one side plate of the pair of side plates of the sheet feeding cartridge or one movable rail of the pair of movable rails facing to the one side plate and located between the one side plate and the one movable rail, wherein in a case where the pressing part is provided in the one side plate of the sheet feeding cartridge, the pressing part applies biasing force to the one movable rail in a direction orthogonal to the taking-out and taking-in directions, and thereby, makes another side plate facing to the one side plate in the sheet feeding cartridge to come into pressure contact with another movable rail facing to the one movable rail, in a case where the pressing part is provided in the one movable rail, the pressing part applies biasing force to the one side plate of the sheet feeding cartridge in a direction orthogonal to the taking-out and taking-in directions, and thereby, makes the other side plate of the sheet feeding cartridge to come into pressure contact with the other movable rail.

2. The sheet feeding device according to claim 1, wherein the sheet feeding cartridge is installed between the pair of movable rails from the upper side in a state that the pair of movable rail are drawn out, the pressing part includes:

a contacting member movably provided in a direction orthogonally crossing the taking-out and taking-in directions; and a biasing member pressing the contacting member against the sheet feeding cartridge or the one movable rail.

3. The sheet feeding device according to claim 2, wherein the contacting member has a tapered face tapering toward a side of the sheet feeding cartridge or a side of the one movable rail.

4. An image forming apparatus comprising the sheet feeding device according to claim 3.

5. An image forming apparatus comprising the sheet feeding device according to claim 2.

6. The sheet feeding device according to claim 1, wherein the pressing part is provided in a plurality of numbers apart from each other in the taking-out and taking-in directions.

7. An image forming apparatus comprising the sheet feeding device according to claim 6.

8. The sheet feeding device according to claim 1, further comprising:

an intermediate rail provided to move in the taking-out and taking-in directions along the fixed rail, and having an intermediate base plate, a pair of movable bent parts extending from both of upper and lower end parts of the intermediate base plate to the other side, and a movable curved gap extending in the forward and backward directions on the outer face of the movable bent part;

a first retainer having a first frame and a plurality of balls; and a second retainer having a second frame and a plurality of balls.

9. An image forming apparatus comprising the sheet feeding device according to claim 8.

10. The sheet feeding device according to claim 1, wherein the one side plate of the sheet feeding cartridge is formed in a hollow shape interposing an inner space between an outer plate and an inner plate, the pressing part is provided in the inner space of the sheet feeding cartridge, and is capable of protruding from the outer plate.

11. An image forming apparatus comprising the sheet feeding device according to claim 10.

12. An image forming apparatus comprising the sheet feeding device according to claim 1.

13. A sheet feeding device comprising:

a sheet feeding cartridge configured to have a pair of side plates extending in taking-out and taking-in directions, to be formed so as to store a sheet, and to be taken-out and taken-in with respect to an installed part provided in an apparatus main body;

a pair of fixed rails extended in the taking-out and taking-in directions of the sheet feeding cartridge in the installed part;

a pair of movable rails supporting the sheet feeding cartridge and being provided to move in the taking-out and taking-in directions along the pair of fixed rails; and a pressing part provided in one side plate of the pair of side plates of the sheet feeding cartridge or one movable rail of the pair of movable rails facing to the one side plate, a stay member bridged between the pair of movable rails to keep a distance between the pair of movable rails at a downstream side in a drawing-out direction of the sheet feeding cartridge from the installed part;

a pair of supporting pins placed at an upstream side in the drawing-out direction on the pair of movable rails;

a pair of first recessed parts placed at an upstream side in the drawing-out direction on a lower face of a bottom plate of the sheet feeding cartridge; and a pair of second recessed parts placed at a downstream side of the lower surface of the bottom plate of the sheet feeding cartridge in the drawing-out direction and supported by the supporting pin, wherein the sheet feeding cartridge is placed on the pair of movable rails from the upper side, in a case where the pressing part is provided in the one side plate of the sheet feeding cartridge, the pressing part applies biasing force to the one movable rail in a direction orthogonal to the taking-out and taking-in directions, and thereby, makes another side plate facing to the one side plate in the sheet feeding cartridge to come into pressure contact with another movable rail facing to the one movable rail, in a case where the pressing part is provided in the one movable rail, the pressing part applies biasing force to the one side plate of the sheet feeding cartridge in a direction orthogonal to the taking-out and taking-in directions, and thereby, makes the other side plate of the sheet feeding cartridge to come into pressure contact with the other movable rail.

14. The sheet feeding device according to claim 13, wherein a guide member is protruded in the vicinity of the other of the pair of movable rails in the stay member, a fitting part guided by the guide member and fitted between the other movable rail and the guide member is formed in a bottom plate of the sheet feeding cartridge.

15. The sheet feeding device according to claim 14, wherein the guide member has a tapered face tapering toward the other movable rail.

16. An image forming apparatus comprising the sheet feeding device according to claim 15.

17. An image forming apparatus comprising the sheet feeding device according to claim 14.

18. An image forming apparatus comprising the sheet feeding device according to claim 13.

19. A sheet feeding device comprising:

a sheet feeding cartridge configured to have a pair of side plates extending in taking-out and taking-in directions, to be formed so as to store a sheet, and to be taken-out and taken-in with respect to an installed part provided in an apparatus main body;

a pair of fixed rails extended in the taking-out and taking-in directions of the sheet feeding cartridge in the installed part;

a pair of movable rails supporting the sheet feeding cartridge and being provided to move in the taking-out and taking-in directions along the pair of fixed rails; and a pressing part provided in one side plate of the pair of side plates of the sheet feeding cartridge, wherein the pressing part applies biasing force to one movable rail of the pair of movable rails facing to the one side plate in a direction orthogonal to the taking-out and taking-in directions, and thereby, makes another side plate facing to the one side plate in the sheet feeding cartridge to come into pressure contact with another movable rail facing to the one movable rail.

* * * * *